US006109496A

United States Patent [19]

Andrew et al.

[11] Patent Number: 6,109,496

[45] Date of Patent: Aug. 29, 2000

[54] HIP-CARRIED BAG FOR ELECTRICAL EQUIPMENT INCLUDING RADIO TRANSCEIVERS

[76] Inventors: Irvin Andrew; Katrin Schnabl, both of 204 W. Houston St., #1B, New York, N.Y. 10014

[21] Appl. No.: 09/112,847

[22] Filed: Jul. 10, 1998

[51] Int. Cl.[7] ..... A45C 1/04

[52] U.S. Cl. ..... 224/664; 224/223; 224/250; 224/660; 224/676; 224/930

[58] Field of Search ..... 224/664, 223, 224/660, 662, 663, 676, 682, 930, 246, 237, 250

[56] References Cited

U.S. PATENT DOCUMENTS

| | | | |
|---|---|---|---|
| 666,687 | 1/1901 | Orndorff | 139/390 |
| 4,330,073 | 5/1982 | Clark . | |
| 4,420,078 | 12/1983 | Belt et al. | 206/305 |
| 4,545,414 | 10/1985 | Baum . | |
| 5,038,400 | 8/1991 | Baracat et al. . | |
| 5,205,448 | 4/1993 | Kester et al. . | |
| 5,353,975 | 10/1994 | Libertucci | 224/687 |
| 5,374,919 | 12/1994 | Zelka et al. | 340/574 |
| 5,397,040 | 3/1995 | Lee | 224/679 |
| 5,450,991 | 9/1995 | Neading . | |
| 5,450,993 | 9/1995 | Guerreo et al. . | |
| 5,630,536 | 5/1997 | Bugnaski . | |
| 5,639,004 | 6/1997 | Carlton et al. . | |
| 5,639,005 | 6/1997 | Chouinard . | |

*Primary Examiner*—Gregory M. Vidovich
*Assistant Examiner*—Maerena W. Brevard
*Attorney, Agent, or Firm*—R. Neil Sudol; Henry D. Coleman

[57] ABSTRACT

A bag for wearing by a user at a waist or hip region and for carrying a load such as several electronic communications devices has a substantially rectangular main panel and auxiliary panels disposed on the main panel and defining at least one compartment or receptacle for holding an object. The main panel has an upper edge lying along a line and two opposed lateral edges oriented substantially perpendicularly to the line. A belt is attached at opposite ends to the main panel along the lateral edges thereof. The belt has a top edge oriented at an acute angle (preferably between 5° and 10°) relative to the upper edge line of the main panel, on a side of the line opposite the main body of main panel. The main panel is engageable with a user upon a securing of the belt about a waist region of the user.

4 Claims, 12 Drawing Sheets

HIP-CARRIED BAG FOR ELECTRICAL EQUIPMENT INCLUDING RADIO TRANSCEIVERS

BACKGROUND OF THE DISCLOSURE

This invention relates to a bag. More particularly, this invention relates to a bag of the type worn at the waist or the hip.

Many workers at film and stage production sites and construction sites, as well as management and security personnel at large social and business events, must carry one or more pieces of equipment for facilitating or enabling proper job performance. Such equipment commonly includes electronic communication devices such as two-way radios, cellular telephones, and beepers. The user normally carries these devices in his or her hands, which inhibits the use of the hands for other purposes. Pockets on clothing are generally too small to carry two-way radios, while most carry-all bags are too large and bulky to carry cellular telephones and beepers. Conventional waist or hip bags, conventionally termed "fanny packs," are not designed to ensure that the communication equipment is readily accessible and securely held. Moreover, conventional fanny packs are not conducive to holding several pieces of sensitive electronic communications equipment.

It is known to carry equipment such as two-way radios in holsters or holders which are laced onto the wearer's belt. Each such holder is limited to a single piece of equipment and cannot carry other items of any nature.

OBJECTS OF THE INVENTION

An object of the present invention is to provide a bag which is suitable for carrying one or more electronic devices such as two-way radios, cellular telephones, and beepers.

Another object of the present invention is to provide such a bag which is adapted for securing to a user's waist or hip region.

A further object of the present invention is to provide such a bag for securely carrying one or more electronic devices.

An additional object of the present invention is to provide such a bag which facilitates frequent use of electronic devices carried in the bag.

Yet another object of the present invention is to provide such a bag which conforms to the user in the waist or hip region.

It is a supplemental object of the present invention to provide a multifunctional combination fanny-pack and radio holder.

These and other objects of the present invention will be apparent from the drawings and descriptions herein.

SUMMARY OF THE INVENTION

A bag for wearing by a user at a waist or hip region and for carrying a load such as several electronic communications devices comprises, in accordance with the present invention, a substantially rectangular main panel and auxiliary panels disposed on the main panel and defining at least one compartment or receptacle for holding an object. The main panel has an upper edge lying along a line and two opposed lateral edges oriented substantially perpendicularly to the line. A belt is attached at opposite ends to the main panel along the lateral edges thereof. The belt has a top edge oriented at an acute angle (preferably between 5° and 10°) relative to the upper edge line of the main panel, on a side of the line opposite the main body of main panel. The main panel is engageable with a user upon a securing of the belt about a waist region of the user.

According to a feature of the present invention, the auxiliary panels include a pair of oppositely disposed panels in part defining a special compartment for holding a two-way radio, the oppositely disposed panels have upper end portions provided with apertures. These apertures allow user access to a push-to-talk button of the two-way radio, regardless of whether the bag is worn on the left hip or the right hip.

It is contemplated that the special compartment has an open upper side. At least one retaining band (and preferably two) extends over the open upper side of the special compartment for holding the two-way radio therein. The retaining band is separably fastened at one end to one of the auxiliary panels. The separable fastening of the retaining band may be accomplished by a snap-lock fastener, a ball-and-socket fastener, a spring-loaded latch, a pin and loop, a push-release buckle, a schoolbag-type buckle, or any other known fastener.

According to another feature of the present invention, the auxiliary panels define a rectangular prismatic primary compartment having a plurality of sides, while the special compartment is located at one of the sides of the primary compartment. Also, a pouch may be removably attached to another side of the primary compartment. The pouch may be connected via a zipper assembly to the primary compartment.

In a specific embodiment of the present invention, the primary compartment extends upwardly beyond an upper edge of the main panel, while the main panel and concomitantly the belt are removably attached to the auxiliary panels and the primary compartment. The bag further comprises a shoulder strap removably attached to the auxiliary panels at an upper end of the primary compartment.

According to a further feature of the present invention, the belt includes a pair of substantially trapezoidal extensions each connected along one edge to a respective one of the lateral edges of the main panel. Preferably, the edges of the extensions connected to the main panel each have a length approximately equal to the length of the respective lateral edge of the main panel.

The main panel may partially define a pocket for receiving and temporarily storing the extensions, for example, if the bag is to be used as a shoulder bag rather than as a hip bag.

Generally, it is contemplated that the belt includes a pair of segments and a locking device for releasably fastening the segments to one another, each of the segments being connected at one end to the main panel along a respective one of the lateral edges.

A bag in accordance with the present invention is suitable for carrying one or more electronic devices such as two-way radios, cellular telephones, and beepers. The bag is secured close to the person of the user and does not sag outwardly as waist or hip bags are prone to do when carrying a sugnificant load. Moreover, the bag provides for the securing of electronic devices to the bag in such a way that the devices are easily accessible, even while remaining in the bag.

DESCRIPTION OF THE PREFERRED EMBODIMENTS

As illustrated in FIGS. 1–5, a storage and transport bag for wearing by a user at a waist or hip region and for carrying a load such as several electronic communications devices comprises a substantially rectangular main panel 12 and a plurality of auxiliary panels 14 disposed on or connected to the main panel. Main panel 12 is generally a support panel which engages hip region of a user. Auxiliary panels 14 define a primary compartment, receptacle or pouch 16 which is closed on an upper side by a zipper member 18.

Figure 27:
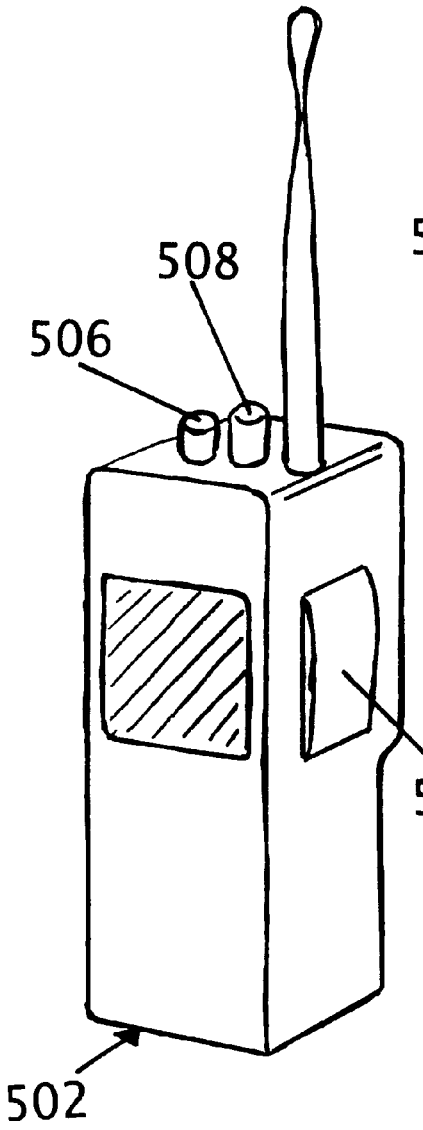
FIG. 27 is a schematic perspective view of a two-way radio to which the present invention is adapted.
Figure 28:
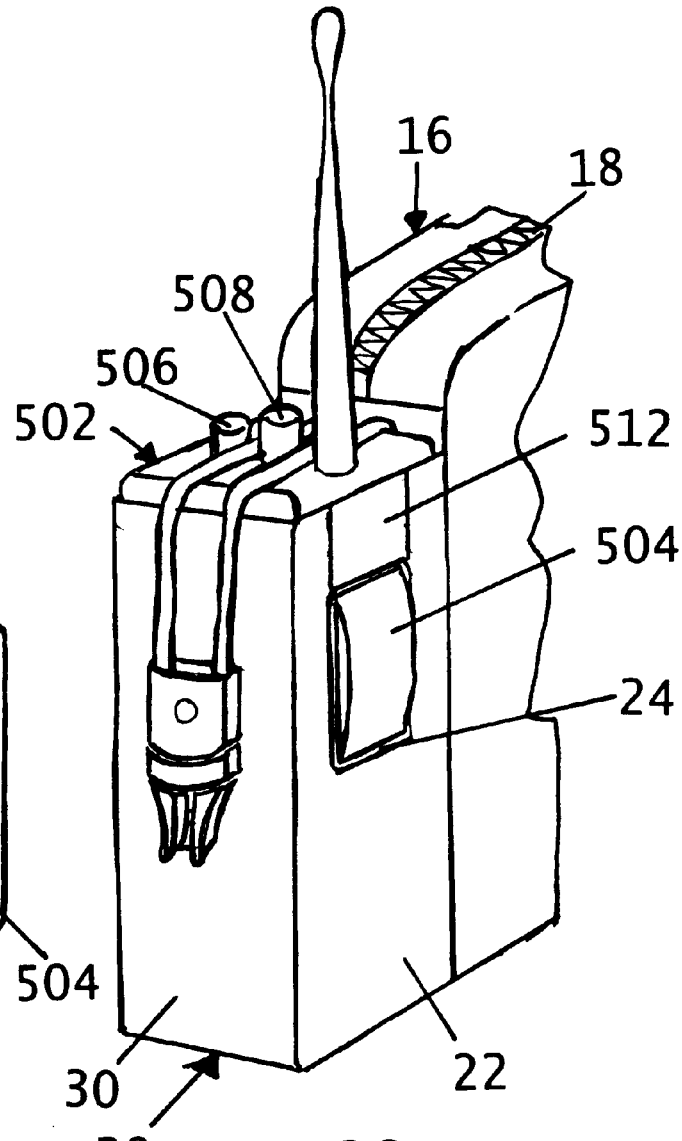
FIG. 28 is a partial schematic perspective view of a modified version of the bag of FIG. 1, showing the radio of FIG. 27 inserted into a compartment, receptacle or pouch of the bag.

Auxiliary panels 14 further define a special compartment, receptacle or pouch 20 for holding a two-way radio 502 (FIGS. 27 and 28). Two auxiliary panels 22 defining opposite sides of special compartment 20 are provided in upper portions with respective windows or apertures 24 for allowing access to a push-to-talk button 504 (FIGS. 27 and 28) of two-way radio 502. Radio 502 thus remains in compartment 20 during use of the radio. The provision of two opposed windows 24 facilitates use of two-way radio 502 regardless of whether the bag is perched on the left hip or the right hip of a user. One or two elastic or non-elastic cords or straps 26 are permanently attached at one end to a seam 28 of compartment 16 and are releasably fastened at another end to a panel 30 of compartment 20 via a releasable connector 32 such as a snap-lock fastener, a ball-and-socket connector, a latch, a push-release buckle, a schoolbag-type buckle, or any other known fastener. Straps 26 are disposed across the open upper side of compartment 20 so as to permit access to an on-off-volume control 506 and a channel-changer control 508 (FIGS. 27 and 28) on an upper side of two-way radio 502 in compartment 20.

A front side of primary compartment 16 is provided with a pair of pockets 34 and 36, one provided with a reflective strip 38 and each provided with a respective cover flap 40 and 42. One or both of the pockets 34 and 36 may be provided at a rear side with one or more additional pockets or compartments 44 for receiving respective pens and other elongate implements (not shown). On a lateral side of primary compartment 16 opposite special compartment 20 is provided an ancillary compartment 46 with a VELCRO™-fastened cap 48 for holding a cellular phone and batteries, for example.

Main panel 12 has an upper edge 50 lying along a line 52 and two opposed lateral edges 54 and 56 oriented substantially perpendicularly to the line. A belt 58 is attached at opposite ends to main panel 12 along lateral edges 54 and 56 thereof. Belt 58 includes a pair of generally trapezoidal or quadrilateral extensions 60 and 62 which are connected along respective ends or boundaries to lateral edges 54 and 56 of main panel 12, respectively.

Figure 8:
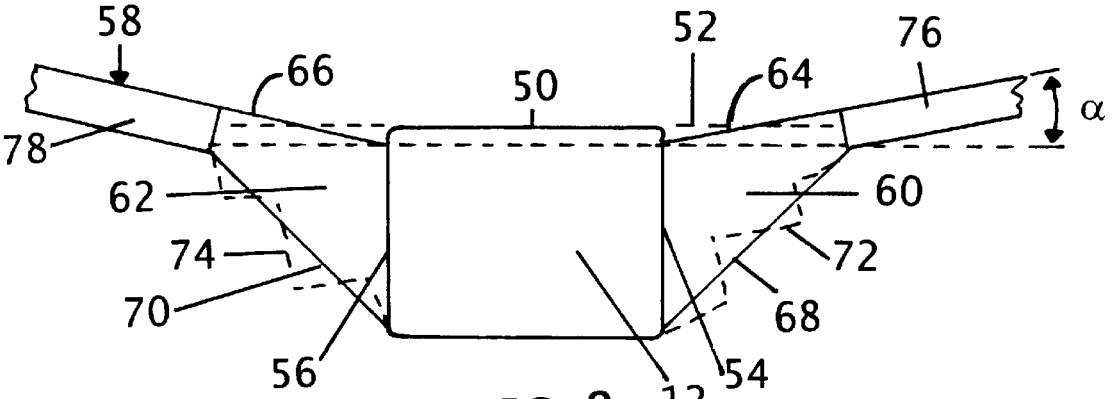
FIG. 8 is a partial front elevational view of a rear panel of the bag of FIGS. 1–5, showing attachment of the belt to the rear panel of the bag.

As illustrated particularly in a flattened front elevational view in FIG. 8, extensions 60 and 62 have upper edges 64 and 66 which extend at an acute angle $\alpha$ (preferably between 5° and 10° and more preferably between 8° and 10°) upwardly relative to line 52, on a side of line 52 opposite a major portion of main panel 12. The edges (not separately designated) of extensions 60 and 62 connected to main panel 12 each have a length approximately equal to the length of the respective lateral edge 54 or 56 of main panel 12. Thus, extensions 60 and 62 are substantially coextensive, along their inner sides, with edges 54 and 56 of main panel 12. It is to be noted that lower edges 68 and 70 of extensions 60 and 62 need not be linear, but may have a wide range of alternative configurations, e.g., saw-tooth shapes 72 and 74. Main panel 12 engages a user's hip region upon a securing of belt 58 about a waist region of the user.

Figure 1:
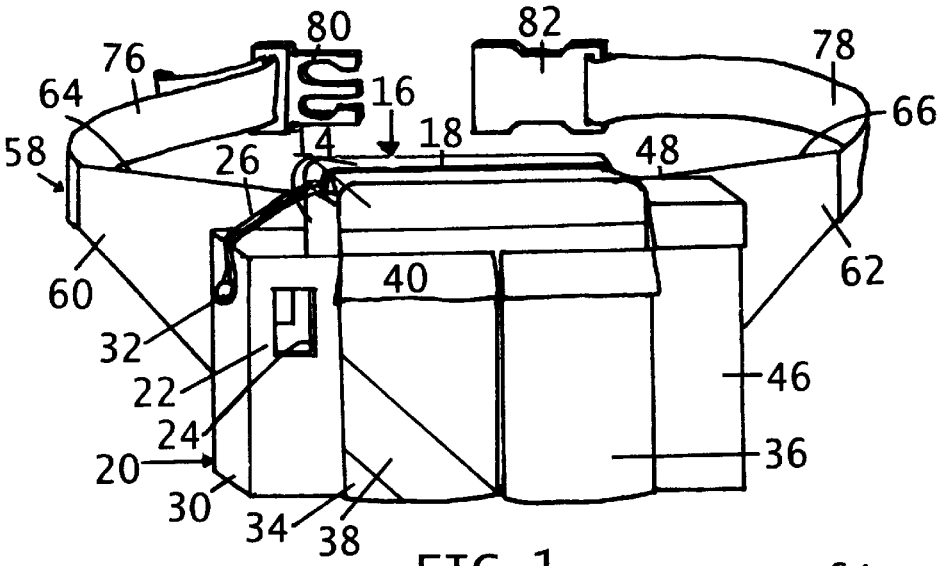
FIG. 1 is a left front perspective view of a first embodiment of a waist or hip bag in accordance with the present invention.
Figure 2:
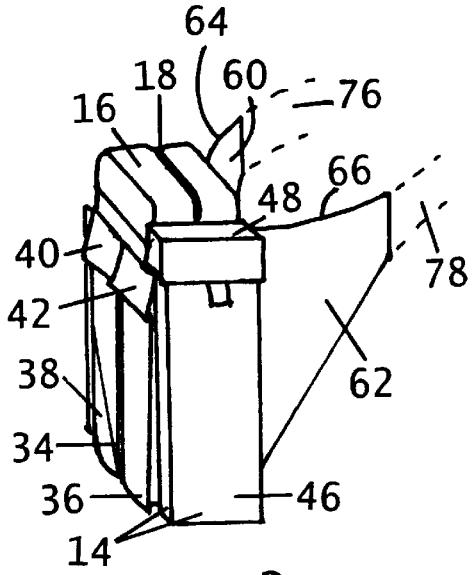
FIG. 2 is a front right perspective view of the bag of FIG. 1.
Figure 3:
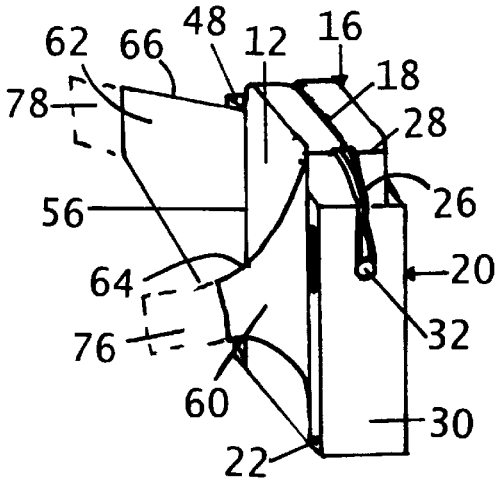
FIG. 3 is a rear left perspective view of the bag of FIGS. 1 and 2.
Figure 4:
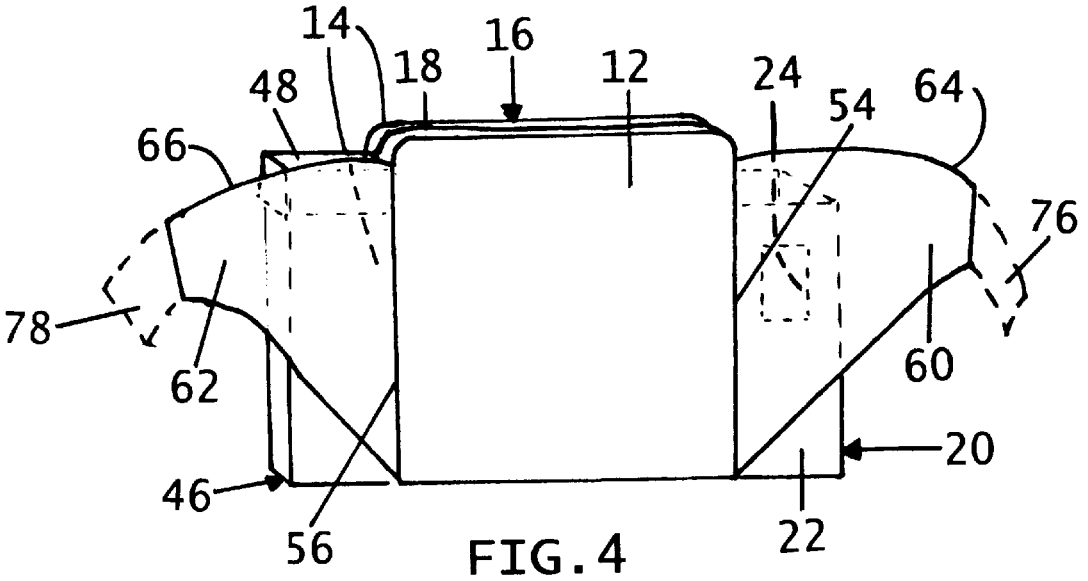
FIG. 4 is a generally rear perspective view of the bag of FIGS. 1–3.
Figure 5:
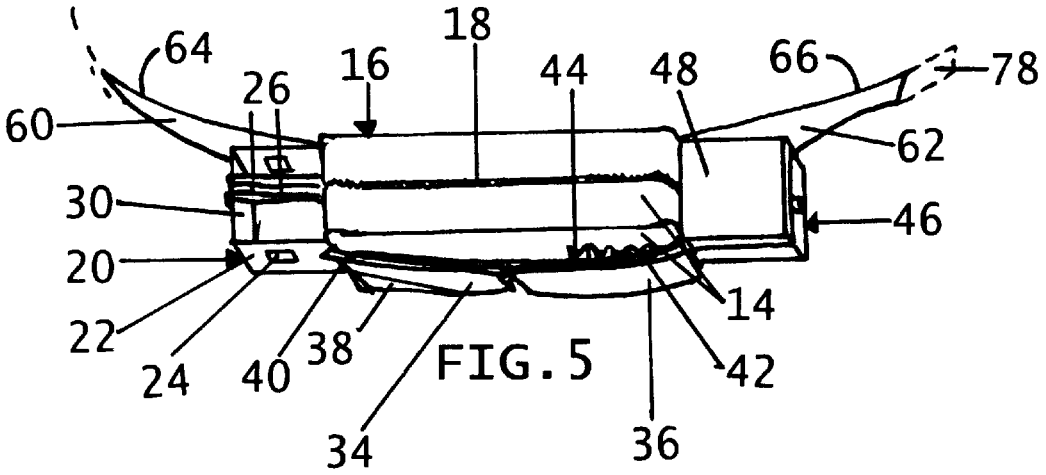
FIG. 5 is a top perspective view of the bag of FIGS. 1–4.

As illustrated in FIG. 1, belt 58 includes elongate strap segments 76 and 78 connected to respective extensions 60 and 62 and provided at free ends with resilient buckle fasteners 80 and 82. Of course, other kinds of fasteners may be alternatively used.

Figure 6A:
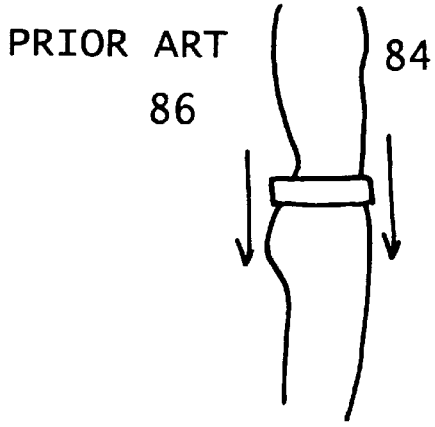
FIG. 6A is a diagram showing a conventional waist or hip belt attached to a person.
Figure 6B:
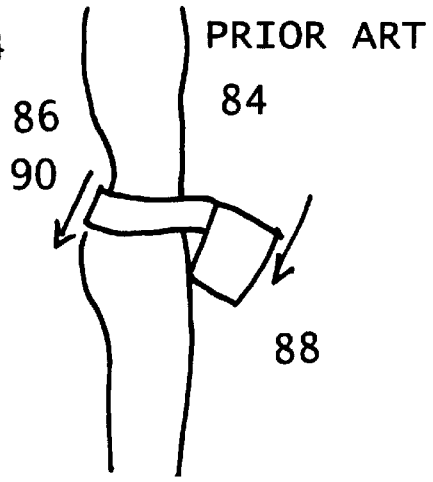
FIG. 6B is a diagram showing the belt of FIG. 6A when stressed by a heavy load.

As illustrated in FIG. 6A, a conventional belt 84 has a cylindrical shape and is worn at or about the waist 86 of a person. Because the body is tapered outwardly away from the waist 86, belt 84 does not conform to the user's body. When a load 88 is appended to the belt 84, as shown in FIG. 6B, the belt shifts so that a side 90 of the belt opposite the load is brought into increased contact with the user's body, while at the load, the belt is drawn away from the body. Thus, load 88 is precariously carried at a significant angle to the user's body. This inevitable geometry not only makes the load harder to carry but can also result in parts of the load falling out.

Figure 7A:
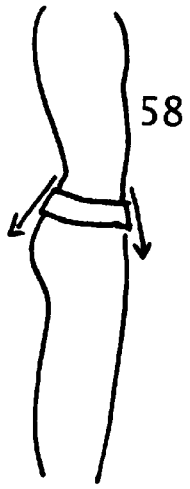
FIG. 7A is a diagram similar to FIG. 6A, showing a belt design in accordance with the present invention.
Figure 7B:
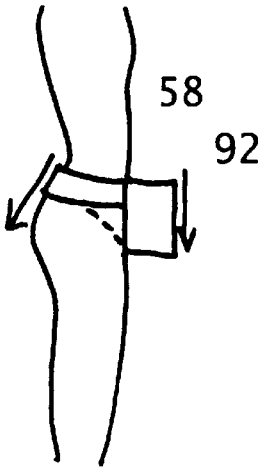
FIG. 7B is a diagram similar to FIG. 6B, showing the belt design of FIG. 7A when stressed by a heavy load.

FIGS. 7A and 7B illustrate the geometry extant where belt 58 and a bag 92 (e.g., FIGS. 1–5) is coupled to a user UR about the waist 86. Belt 58 conforms to the person of the user and bag 92 is carried against the user's body, without a significant outward sag. This result obtains owing to the belt configuration described hereinabove with reference to FIG. 8.

As depicted in FIGS. 9–13, another storage and transport bag for wearing by a user at a waist or hip region and for carrying a load exemplarily including one or more electronic communications devices comprises a substantially rectangular main panel 112 and a plurality of auxiliary panels 114 disposed on or connected to the main panel. Main panel 112 is generally a support panel which engages hip region of a user. Auxiliary panels 114 define a first compartment, receptacle or pouch 116 which is closed on an upper side by a cap 118.

Auxiliary panels 114 further define a second compartment, receptacle or pouch 120 for holding two-way radio 502 (FIG. 27). An auxiliary panel 122 of special compartment 120 is provided in an upper region with a window or aperture 124 for allowing access to a push-to-talk button 504 of two-way radio 502 (FIG. 27). The radio may remain in compartment 120 during use.

One or two elastic or non-elastic straps 126 are permanently attached at one end to main panel 112 and are releasably fastened at another end to panel 122 of compartment 120 via a releasable connector 132 such as a snap-lock fastener, a ball-and-socket connector, a latch, a push-release buckle, a schoolbag-type buckle, or any other known fastener. Straps 126 are disposed across the open upper side of compartment 120 so as to permit access to on-off-volume and channel-changer controls (506 and 508 in FIGS. 27 and 28) on an upper side of a two-way radio (502 in FIG. 27) in compartment 120.

Figure 11:
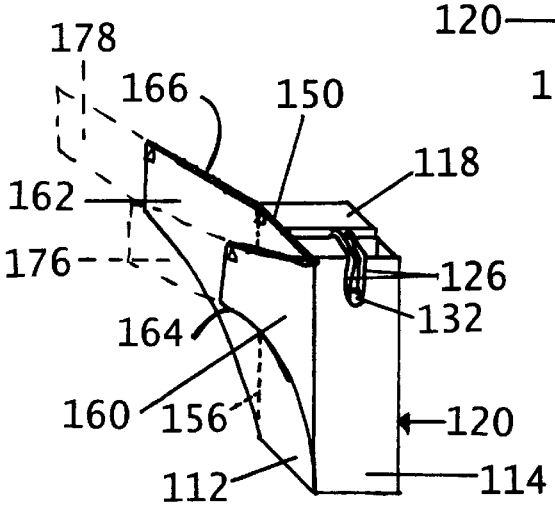
FIG. 11 is a rear left-side perspective view of the bag of FIGS. 9 and 10.
Figure 12:
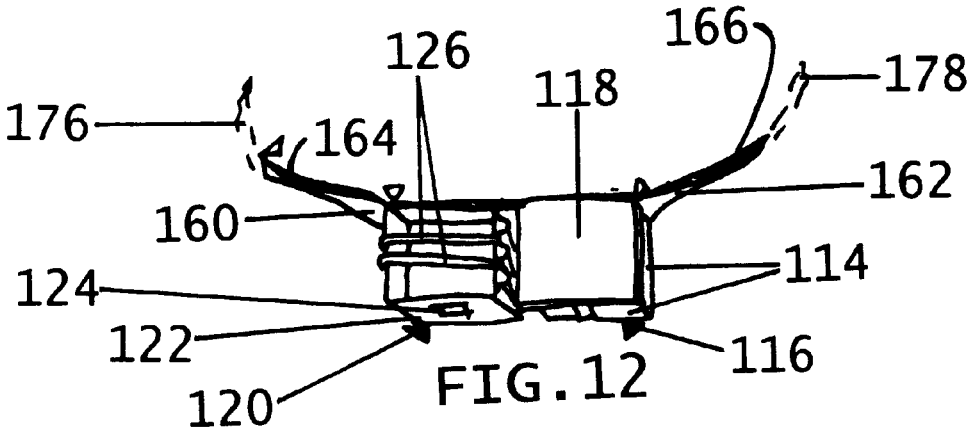
FIG. 12 is a top perspective view of the bag of FIGS. 9–11.
Figure 13:
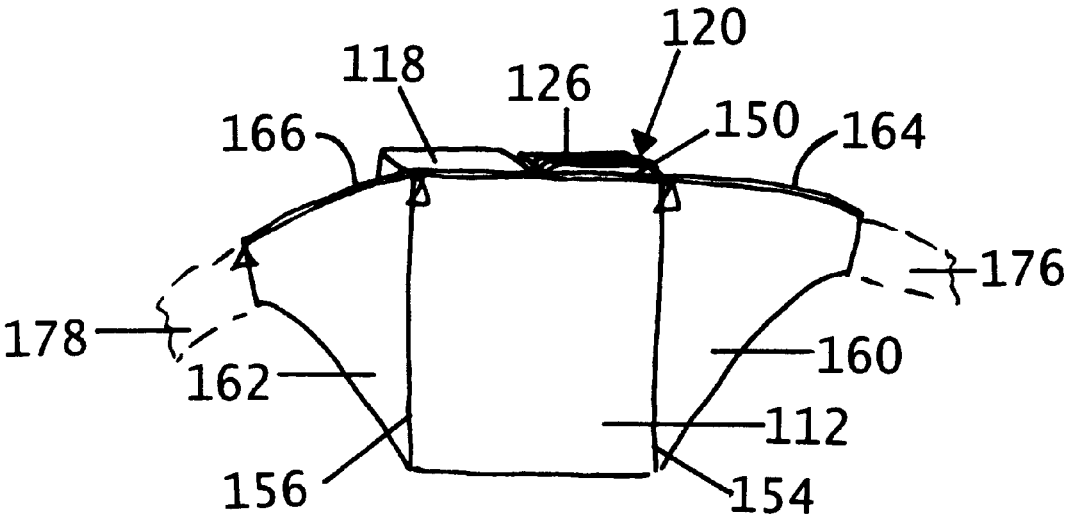
FIG. 13 is a generally rear perspective view of the bag of FIGS. 9–13.

Main panel 112 has an upper edge 150 (FIGS. 11 and 13 lying along a line 152 and two opposed lateral edges 154 and 156 oriented substantially perpendicularly to the line. A belt 158 is attached at opposite ends to main panel 112 along lateral edges 154 and 156 thereof. Belt 158 includes a pair of generally trapezoidal or quadrilateral extensions 160 and 162 which are connected along respective ends or boundaries to lateral edges 154 and 156 of main panel 112, respectively.

Extensions 160 and 162 have the geometric relationship with respect to main panel 112 described hereinabove with reference to FIG. 8. Upper edges 164 and 166 of belt extensions 160 and 162 extend at an acute angle $\alpha$ of between 5° and 10° (preferably between 8° and 10°) upwardly relative to line 152, on a side of line 152 opposite a major portion of main panel 112. The edges (not separately designated) of extensions 160 and 162 connected to main panel 112 each have a length approximately equal to the length of the respective lateral edge 154 or 156 of main panel 112. Thus, extensions 160 and 162 are substantially coextensive, along their inner sides, with edges 154 and 156 of main panel 112. It is to be noted that lower edges 168 and 170 of extensions 160 and 162 need not be linear, but may have a wide range of alternative contours. Main panel 112 engages a user's hip region upon a securing of belt 158 about a waist region of the user.

Figure 9:
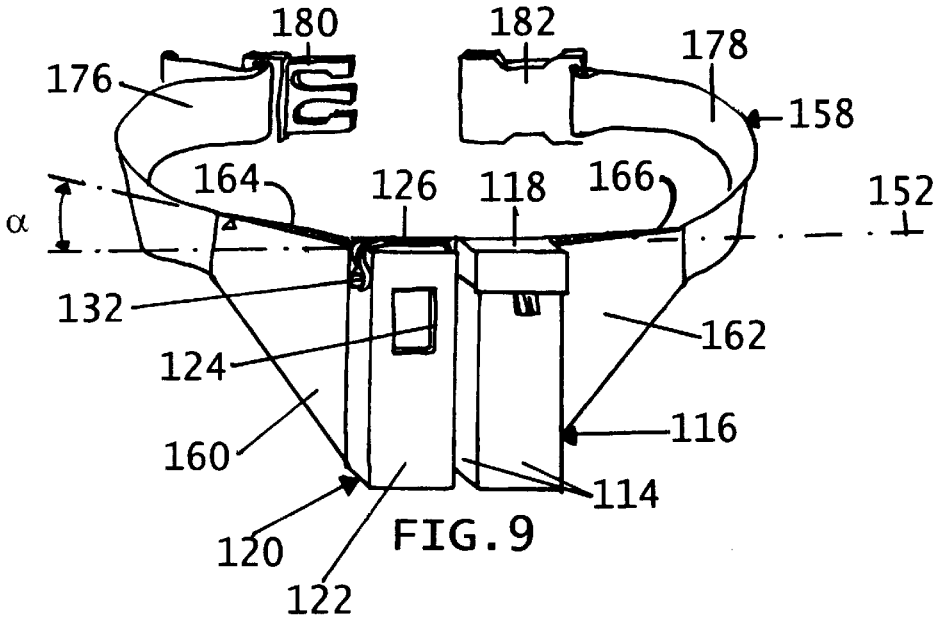
FIG. 9 is a left front perspective view of a second embodiment of a waist or hip bag in accordance with the present invention.
Figure 10:
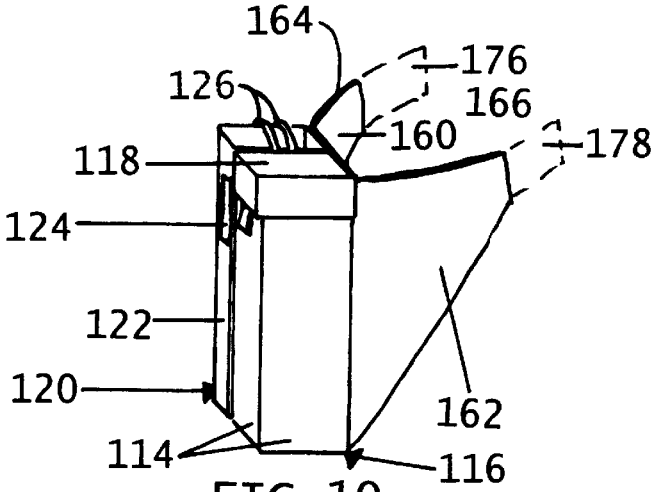
FIG. 10 is a front right-side perspective view of the bag of FIG. 9.

As illustrated in FIG. 9, belt 158 includes elongate strap segments 176 and 178 connected to respective extensions 160 and 162 and provided at free ends with resilient buckle fasteners 180 and 182. Of course, other kinds of fasteners may be alternatively used.

FIGS. 14–18 show a further storage and transport bag for wearing by a user at a waist or hip region and for carrying items such as electronic communications devices. The bag comprises a substantially rectangular main panel 212 and a plurality of auxiliary panels 214 disposed on or connected to the main panel. Main panel 212 is generally a support panel which engages hip region of a user. Auxiliary panels 214 define a primary compartment, receptacle or pouch 216 which is closed on an upper side by a zipper member 218.

Auxiliary panels 214 further define a special compartment, receptacle or pouch 220 for holding a two-way radio (502 in FIG. 27). Two auxiliary panels 222 defining opposite sides of special compartment 220 are provided in upper portions with respective windows or apertures 224 for allowing access to a push-to-talk button (504 in FIGS. 27 and 28) of two-way radio 502 (FIGS. 27 and 28). The radio thus remains in compartment 220 during use of the radio. The provision of two opposed windows 224 facilitates use of the two-way radio regardless of whether the bag is perched on the left hip or the right hip of a user. One or two elastic or non-elastic straps 226 are permanently attached at one end to a seam 228 of compartment 216 and are releasably fastened at another end to a panel 230 of compartment 220 via a releasable connector 232 such as a snap-lock fastener, a ball-and-socket connector, a latch, a push-release buckle, a schoolbag-type buckle, or any other known fastener. Straps 226 are disposed across the open upper side of compartment 220 so as to permit access to on-off-volume and channel-changer controls (506 and 508, FIGS. 27 and 28) on an upper side of a two-way radio in compartment 220.

Attached to a front side of primary compartment 216 via a zipper or other releasably connector member 234 are auxiliary panels defining a secondary compartment 236. Compartment 236 has a closure zipper 237 and is provided along a front face with a pocket 238 and a cover flap 240. A side or lateral panel 242 of secondary compartment 236 is formed with a plurality of elongate pockets 244 for receiving respective pens and other elongate implements (not shown). On a lateral side of primary compartment 216 opposite special compartment 220 is provided an ancillary compartment 246 with a VELCRO™-fastened cap 248 for holding a cellular phone and batteries, for example.

Main panel 212 has an upper edge 250 lying along a line (not separately illustrated) and two opposed lateral edges 254 and 256 oriented substantially perpendicularly to the line. A belt 258 is attached at opposite ends to main panel 212 along lateral edges 254 and 256 thereof. Belt 258 includes a pair of generally trapezoidal or quadrilateral extensions 260 and 262 which are connected along respective ends or boundaries to lateral edges 254 and 256 of main panel 212, respectively.

Extensions 260 and 262 have upper edges 264 and 266 which extend at an acute angle of between 5° and 10° and more preferably between 8° and 10° upwardly relative to the line of edge 250, on a side of that line opposite a major portion of main panel 212. The edges (not separately designated) of extensions 260 and 262 connected to main panel 212 each have a length approximately equal to the length of the respective lateral edge 254 or 256 of main panel 212. Thus, extensions 260 and 262 are substantially coextensive, along their inner sides, with edges 254 and 256 of main panel 212. It is to be noted that lower edges 268 and 270 of extensions 260 and 262 need not be linear. Main panel 212 engages a user's hip region upon a securing of belt 258 about a waist region of the user.

Figure 14:
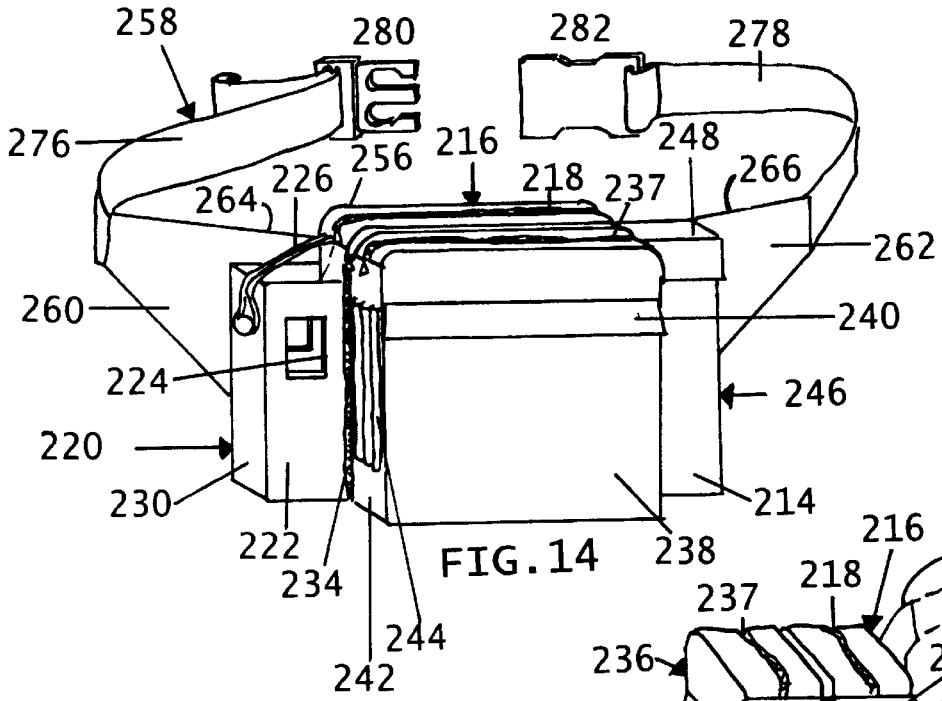
FIG. 14 is a left front perspective view of a third embodiment of a waist or hip bag in accordance with the present invention.
Figure 15:
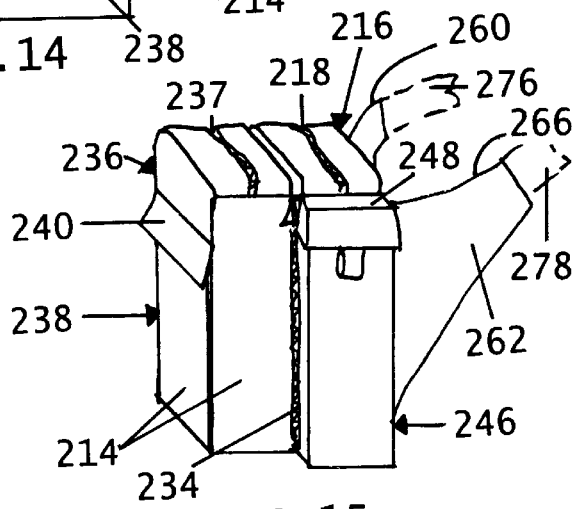
FIG. 15 is a front right-side perspective view of the bag of FIG. 14.
Figure 16:
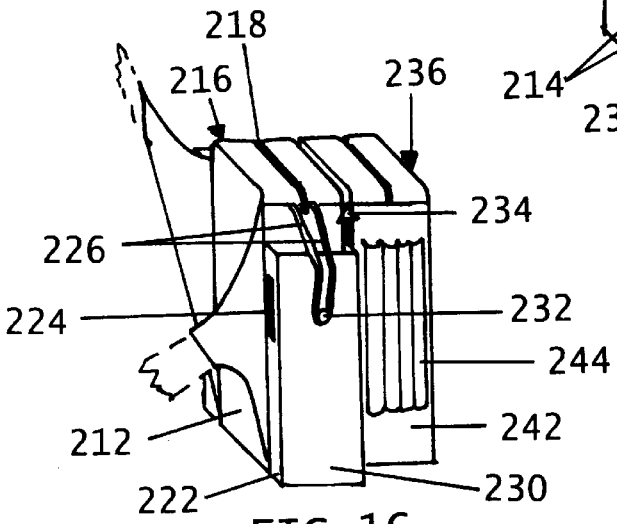
FIG. 16 is a rear left-side perspective view of the bag of FIGS. 14 and 15.
Figure 17:
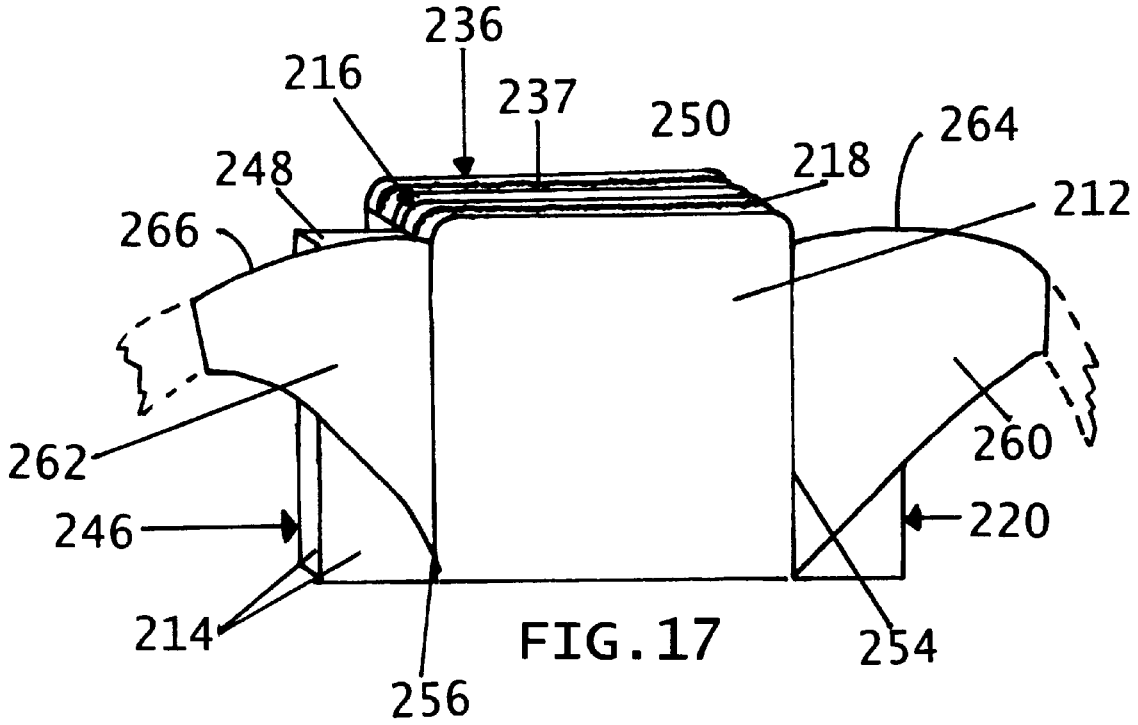
FIG. 17 is a generally rear perspective view of the bag of FIGS. 14–16.
Figure 18:
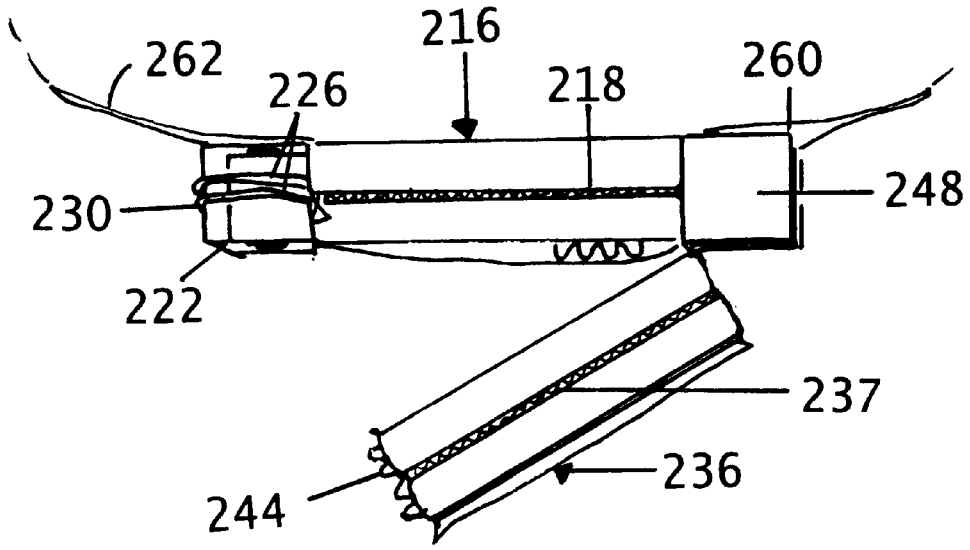
FIG. 18 is a generally top perspective view of the bag of FIGS. 14–17.

As illustrated in FIG. 14, belt 258 includes elongate strap segments 276 and 278 connected to respective extensions 260 and 262 and provided at free ends with resilient buckle fasteners 280 and 282. Again, other kinds of fasteners may be substituted.

FIGS. 19–22 depict a storage and transport bag for wearing by a user at a waist or hip region or, alternatively, with a shoulder strap 300. The bag comprises a substantially rectangular removable main panel 312 (see FIG. 21) to which a belt 358 is attached. Belt 358 includes a pair of trapezoidal extensions 360 and 362 each connected to lateral edges 354 and 356 of main panel 312. Main panel 312 is releasably connected via a zipper 307 to a secondary panel 301 (FIG. 21) which forms a rear side of a primary compartment, receptacle or storage pouch 316. Compartment 316 is substantially taller than main panel 312 and is provided along lateral side panels 302 and 303 with a pair of metal or polymeric connector assemblies 304 and 305 for enable the removable attachment of shoulder strap 300 to an upper end of compartment 316.

The bag of FIGS. 19–22 comprises a plurality of auxiliary panels 314 permanently disposed on or connected to secondary panel 301 and removably connected to main panel 312. Some auxiliary panels 314 are walls of primary compartment 316 which is closed on an upper side by a zipper member 318.

Auxiliary panels 314 further define a special compartment, receptacle or pouch 320 for holding a two-way radio (502 in FIGS. 27 and 28). Two auxiliary panels 322 defining opposite sides of special compartment 320 are provided in upper portions with respective windows or apertures 324 for allowing access to a push-to-talk button (504 in FIGS. 27 and 28) of the two-way radio. The radio thus remains in compartment 320 during use of the radio. The provision of two opposed windows 324 facilitates use of the two-way radio regardless of whether the bag is perched on the left hip or the right hip of a user. One or two elastic or non-elastic straps 326 are permanently attached at one end to a seam (not designated) of compartment 316 and are releasably fastened at another end to a panel 330 of compartment 320 via a releasable connector 332 such as a snap-lock fastener, a ball-and-socket connector, a latch, a push-release buckle, a schoolbag-type buckle, or any other known fastener. Straps 326 are disposed across the open upper side of compartment 320 so as to permit access to on-off-volume and channel-changer controls (506 and 508 in FIGS. 27 and 28) on an upper side of a two-way radio in compartment 320.

A front side of primary compartment 316 is provided with a pair of pockets 334 and 336, one provided with a reflective strip 338 and each provided with a respective cover flap 340 and 342. One or both of the pockets 334 and 336 may be provided at a rear side with one or more additional pockets or compartments (not shown) for receiving respective pens and other elongate implements (not shown). On a lateral side 303 of primary compartment 16 opposite special compartment 320 is provided an ancillary compartment 346 with a VELCRO™-fastened cap 348 for holding a cellular phone and batteries, for example.

Main panel 312 has an upper edge 350 lying along a line 352 substantially perpendicularly to lateral edges 354 and 356. Extensions 360 and 362 have upper edges 364 and 366 which extend at an acute angle $\alpha$ (preferably between 5° and 10° and more preferably between 8° and 10°) upwardly relative to line 352, on a side of line 352 opposite a major portion of main panel 312. The edges (not separately designated) of extensions 360 and 362 connected to main panel 312 each have a length approximately equal to the length of the respective lateral edge 354 or 356 of main panel 12. Thus, extensions 360 and 362 are substantially coextensive, along their inner sides, with edges 354 and 356 of main panel 312. It is to be noted that lower edges 368 and 370 of extensions 360 and 362 need not be linear, but may have a wide range of alternative configurations (not shown). Main panel 312 engages a user's hip region upon a securing of belt 358 about a waist region of the user.

Figure 19:
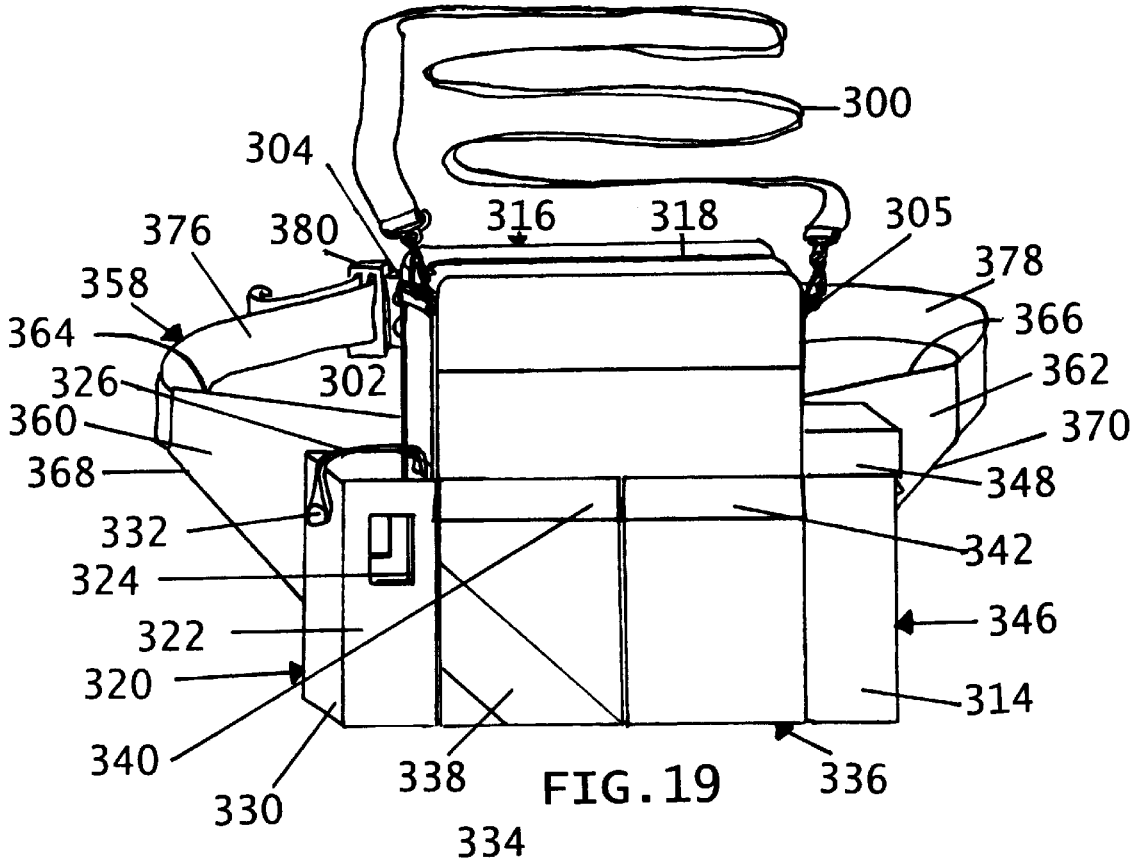
FIG. 19 is a left front perspective view of a fourth embodiment of a waist or hip bag in accordance with the present invention.
Figure 20:
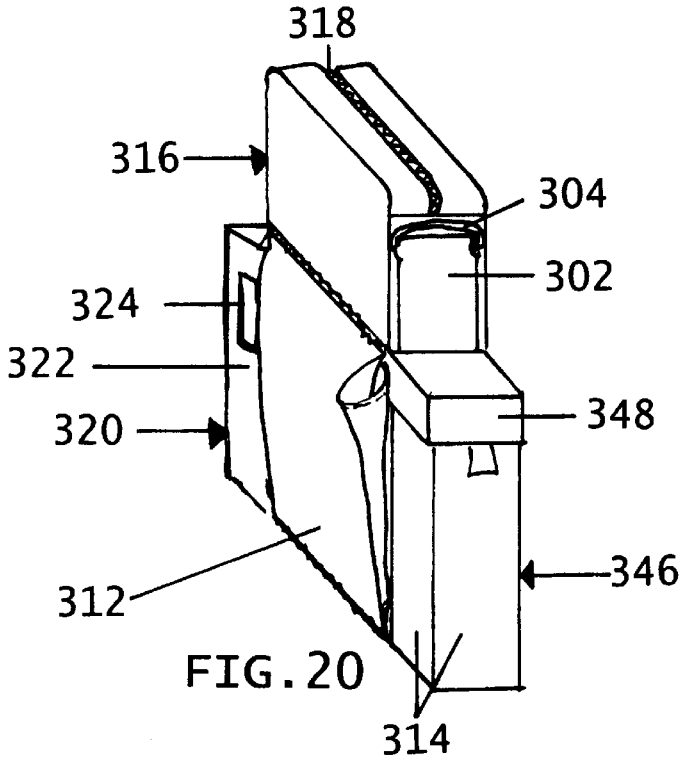
FIG. 20 is a front right-side perspective view of the bag of FIG. 19.
Figure 21:
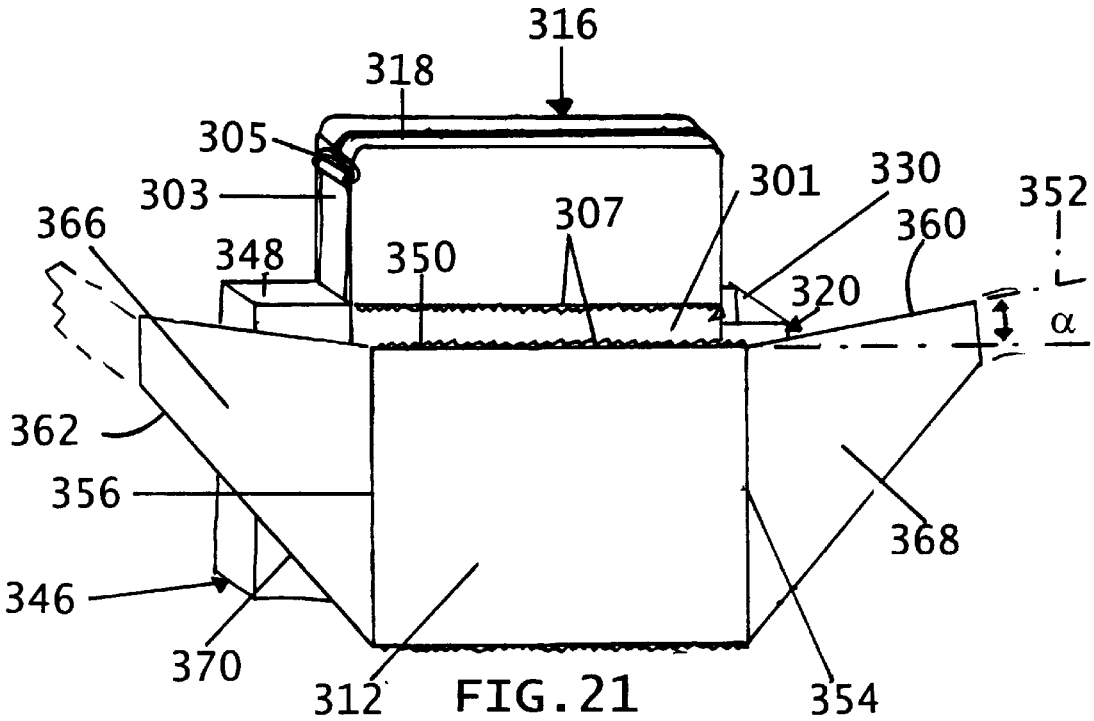
FIG. 21 is a generally rear perspective view of the bag of FIGS. 19 and 20, showing a disconnected belt.
Figure 22:
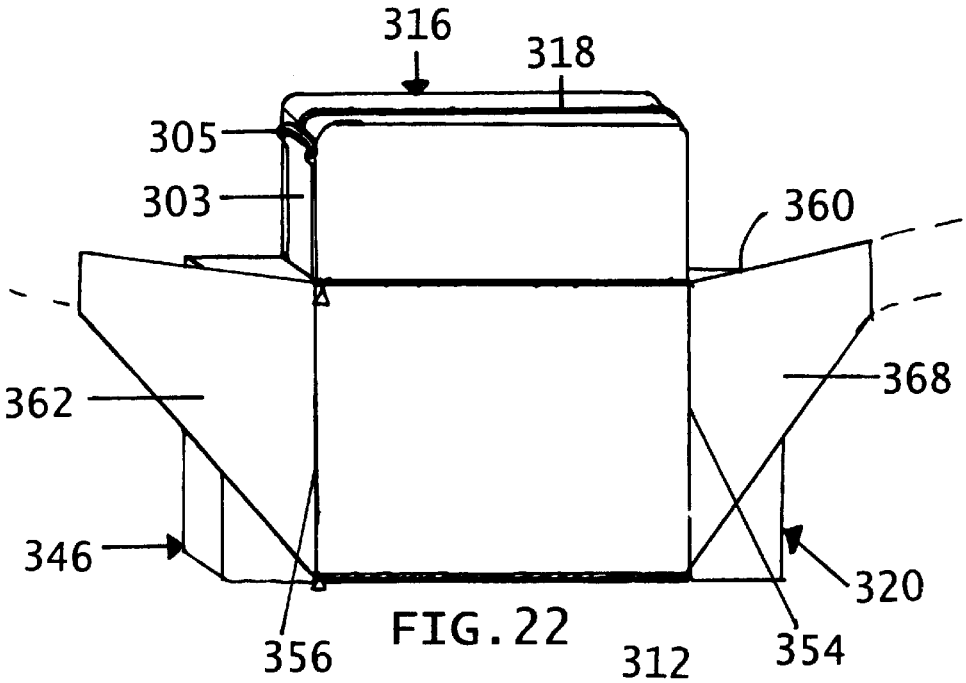
FIG. 22 is a generally rear perspective view similar to FIG. 21, showing the belt connected to the bag.
Figure 23:
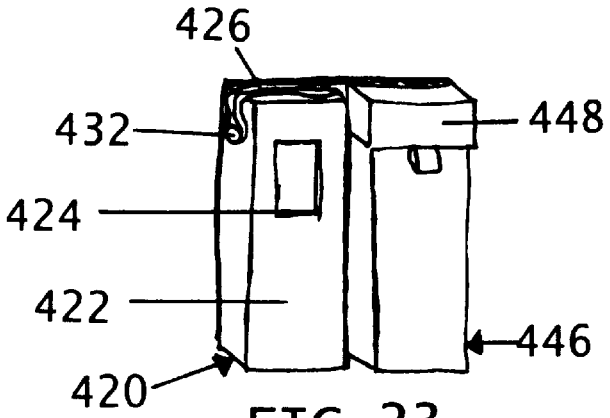
FIG. 23 is a left front perspective view of another embodiment of a bag in accordance with the present invention.
Figure 24:
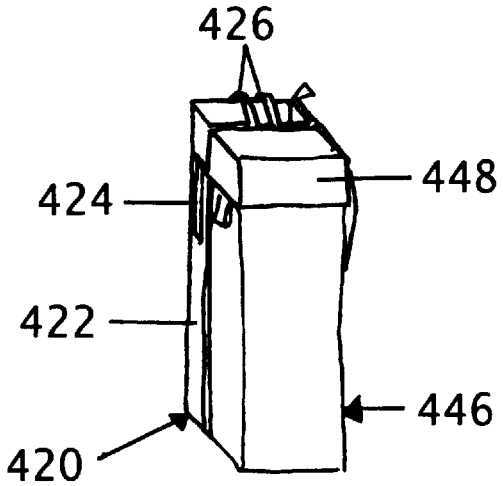
FIG. 24 is a front right-side perspective view of the bag of FIG. 23.
Figure 25:
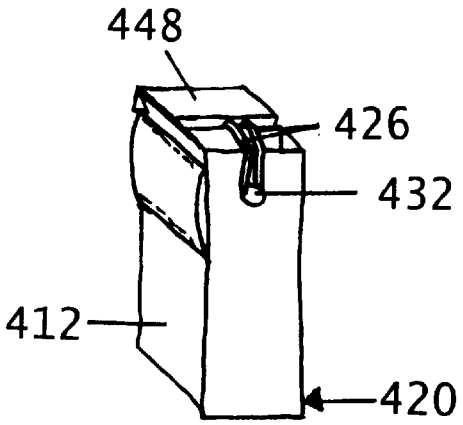
FIG. 25 is a rear left-side perspective view of the bag of FIGS. 23 and 24.

As illustrated in FIG. 19, belt 358 includes elongate strap segments 376 and 378 connected to respective extensions 360 and 362 connectable at free ends with resilient buckle fasteners 380. It is possible, when the bag of FIGS. 19–22 is being used in a shoulder bag mode, to tuck belt 358 between main panel 312 and secondary panel 301 (see FIG. 20).

Figure 26:
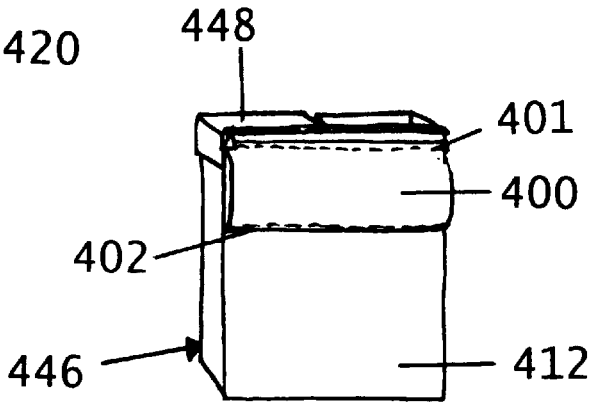
FIG. 26 is a generally rear perspective view of the bag of FIGS. 23–25.

FIGS. 23–26 illustrate a carrier or bag member which is attachable to a user's pants belt (not shown) via a loop 400 (FIG. 26). Loop 400 is attached along horizontal seams 401 and 402 to a rear support panel 412 which forms a rear side of a pair of compartments, receptacles or pouches 420 and 446. Compartment 430 is provided on a front side or in a front panel 430 with a window or aperture 424 for enabling access to control buttons (504) of a two-way radio (e.g., 502) deposited into compartment 420. An elastic or other kind of strap 426 is disposed over an open upper side of compartment 420 for holding the two-way radio in the compartment. One end of strap 426 is releasably fastened to compartment 420 via a connector 432 such as a snap-lock fastener, ball-and socket coupling members, a latch mechanism, a pin and loop, a push-release buckle, a schoolbag-type buckle, or any other known fastener. Compartment 446 is provided with a VELCRO™-closed cap 448.

FIG. 28 basically illustrates a portion of the bag of FIGS. 1–5. Straps 26 are provided with a snap-lock connector or other releasable fastener 510 for removably attaching ends of straps 26 to panel 30. It is to be noted that an upper portion 512 of side panels 22, defining an upper boundary of windows 24, may be formed of an elastic material for facilitating the insertion of certain two-way radios which are wider at an upper end.

Figure 29:
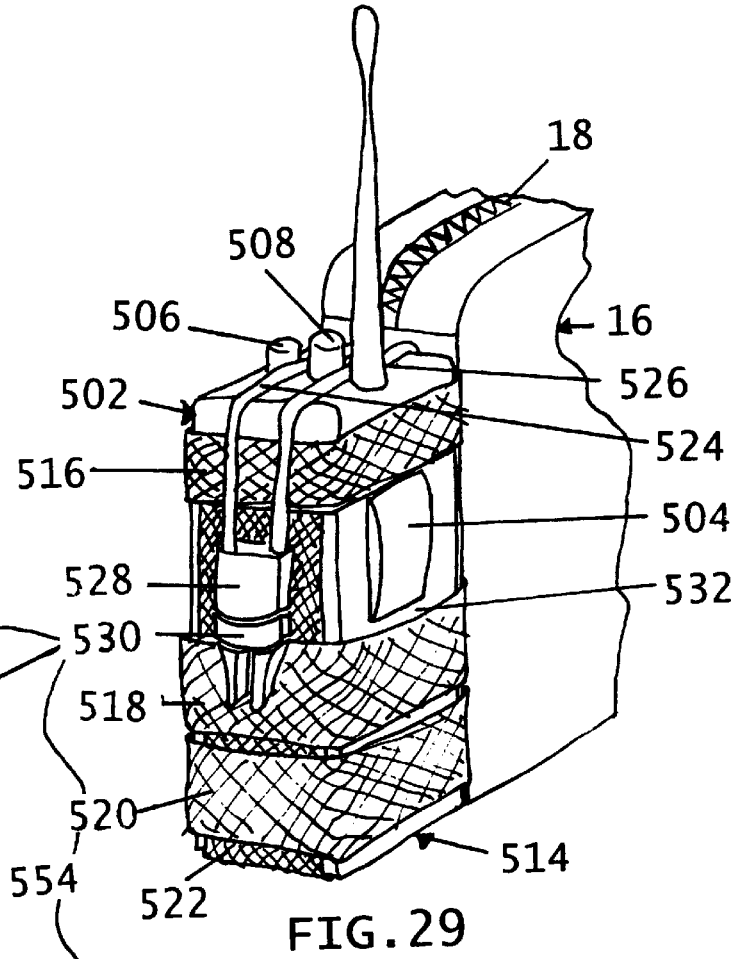
FIG. 29 is a partial schematic perspective view of another modified version of the bag of FIG. 1, showing the radio of FIG. 27 inserted into a compartment, receptacle or pouch of the bag.

FIG. 29 shows a modification of a portion of the bag of FIGS. 1–5. In particular, compartment, receptacle or pouch 20 of FIGS. 1–5 has been replaced by a modified compartment, receptacle or pouch 514 comprising a plurality of bands 516, 518 and 520 disposed one above the other and attached to compartment 16 so as to form a plurality of parallel loops. Another band 522 is disposed in an L-shaped configuration and extends horizontally at a bottom end of compartment 514 and vertically. Band 522 is connected to a lower edge of compartment 16 and to bands 516, 518, and 520. A pair of cords or bands 524 and 526 are connected each at one end to compartment 16 and at an opposite end to a snap lock connector 528. Connector 528 cooperates with another snap-lock connector 530 on band 518 to releasably lock the cords or bands 524 to band 518.

It is to be noted that bands 516, 518 and 522 define a pair of windows or apertures 532 (only one shown) for enabling access to push-to-talk botton 504 of two-way radio 502. Band 516 may be formed of an elastic material for facilitating the insertion of certain two-way radios which are wider at an upper end. Bands 516, 518 and 522 together define opposite panels of compartment 514 in which windows or apertures 532 are located.

Figure 30:
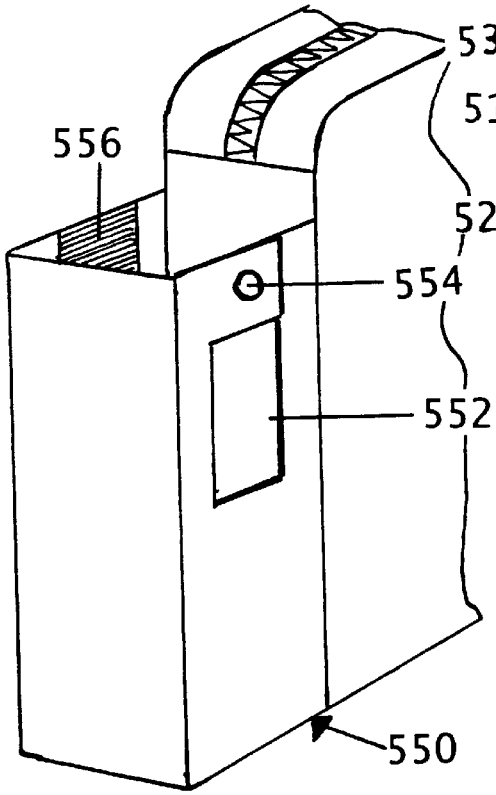
FIG. 30 is a partial schematic perspective view of yet another modified version of the bag of FIG. 1.

As illustrated in FIG. 30, a radio-receiving compartment or pouch 550 of a bag may be provided at an upper end, above one aperture or window 552, with a snap-lock or other closure 554 for facilitating insertion and removal of a radio from the compartment or pouch 550. Above an opposing aperture or window (not shown) is optionally provided an elastic insert 556 like upper portion 512 in FIG. 28.

Although the invention has been described in terms of particular embodiments and applications, one of ordinary skill in the art, in light of this teaching, can generate additional embodiments and modifications without departing from the spirit of or exceeding the scope of the claimed invention. For example, it is to be noted that upper edges 64 and 66, 164 and 166, 264 and 266, 364 and 366, need not be linear. Concomitantly, extensions 60 and 62, 160 and 162, 260 and 262, 360 and 362, need not be polygonal but can assume a more organic shape, such as a kidney shape. The angle of attachment of the upper edges 64 and 66, 164 and 166, 264 and 266, 364 and 366, whether straight or curved, to the respective main panels 12, 112, 212, 312, should be at a concave or acute angle to maintain a snug fit of the bags to the user, even when the bags are carrying a substantial load.

Accordingly, it is to be understood that the drawings and descriptions herein are proffered by way of example to facilitate comprehension of the invention and should not be construed to limit the scope thereof.

What is claimed is:

1. A bag comprising:

a belt;

a plurality of panels defining a compartment for holding a two-way radio, said compartment having an open upper side, said panels being attached to said belt, said panels including two panels disposed opposite to and substantially parallel to one another, said two panels having upper end portions provided with respective mutually aligned apertures; and two retaining cords extending over said open upper side for holding the two-way radio in said compartment, said retaining cords being separably fastened at one end to one of said panels, said cords being disposed across said open upper side so as to permit access to controls on an upper side of the two-way radio in said compartment.

2. The bag defined in claim 1 wherein said compartment comprises a special compartment, said panels defining a rectangular prismatic primary compartment having a plurality of sides, said special compartment being located at one of said sides of said primary compartment.

3. The bag defined in claim 2, further comprising a pouch removably attached to another of said sides of said primary compartment.

4. The bag defined in claim 3 wherein said pouch is connected via a zipper assembly to said another of said sides of said primary compartment.

* * * * *